US010195732B2

(12) United States Patent
Hsieh

(10) Patent No.: US 10,195,732 B2
(45) Date of Patent: Feb. 5, 2019

(54) HAND TOOL WITH A HANDLE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 1283 days.

(21) Appl. No.: 14/222,798

(22) Filed: Mar. 24, 2014

(65) Prior Publication Data

US 2014/0290449 A1 Oct. 2, 2014

(30) Foreign Application Priority Data

Apr. 2, 2013 (TW) ..... 102111964 A

(51) Int. Cl.

| | |
|---|---|
| ***B25G 1/06*** | (2006.01) |
| ***B25B 23/00*** | (2006.01) |
| ***B25G 1/04*** | (2006.01) |
| ***B25G 3/18*** | (2006.01) |
| ***B25G 3/24*** | (2006.01) |

(52) U.S. Cl.

CPC ..... *B25G 1/06* (2013.01); *B25B 23/0042* (2013.01); *B25G 1/043* (2013.01); *B25G 3/18* (2013.01); *B25G 3/24* (2013.01); *B25G 1/063* (2013.01)

(58) Field of Classification Search

CPC . B25G 1/06; B25G 1/043; B25G 3/18; B25G 3/24; B25G 1/005; B25B 23/0042; B25B 23/0021

USPC ..... 81/177.1, 177.4, 177.85

See application file for complete search history.

(56) References Cited

U.S. PATENT DOCUMENTS

| | | | | |
|---|---|---|---|---|
| 1,171,063 | A * | 2/1916 | Nigborowicz | B25B 13/102 81/177.4 |
| 4,696,208 | A * | 9/1987 | Lay | B25B 13/462 81/58 |
| 4,960,016 | A * | 10/1990 | Seals | B25F 1/02 7/100 |
| 6,199,454 | B1 * | 3/2001 | Bergbower | B25B 13/461 81/177.4 |
| 6,349,623 | B1 * | 2/2002 | Peters | B25G 1/085 81/177.4 |
| 6,637,298 | B1 * | 10/2003 | O'Brien | B25B 13/102 81/124.5 |
| 6,684,738 | B2 * | 2/2004 | Huang | B25B 13/461 81/177.4 |

(Continued)

*Primary Examiner* — Monica Carter
*Assistant Examiner* — Danny Hong
(74) *Attorney, Agent, or Firm* — Guice Patents PLLC

(57) ABSTRACT

A hand tool includes a handle, a press member, a shank body and multiple latch assemblies. The handle is formed with a receiving cavity and a locating hole in communication with the receiving cavity. The press member is movably disposed in the locating hole. The shank body is fitted in the receiving cavity and movable relative to the handle. The shank body is formed with multiple sockets. The latch assemblies are respectively mounted in the sockets. When the shank body is moved, (for example, slid or rotated) relative to the handle to make one of the sockets aligned with the locating hole, the latch assembly latches the shank body with the handle. When pressing the press member, the latch assembly unlatches the shank body from the handle, the shank body is movable relative to the handle.

8 Claims, 12 Drawing Sheets

(56) References Cited

U.S. PATENT DOCUMENTS 7,252,022 B1 * 8/2007 Losee ..... B25B 13/102
81/124.5
9,180,578 B2 * 11/2015 Chen ..... B25B 13/102

* cited by examiner

HAND TOOL WITH A HANDLE

BACKGROUND OF THE INVENTION

1. Field of the Invention

The present invention relates generally to a hand tool, and more particularly to a hand tool with a handle and a shank body. The shank body and the handle of the hand tool can be relatively extended/retracted or rotated.

2. Description of the Related Art

FIG. 1 shows a conventional extendable/retractable hand tool structure. The conventional hand tool includes a handle 11, a receiving tube 12, an extendable/retractable shank 13 and an engagement unit 14. The handle 11 is for a user to hold. The receiving tube 12 is fixedly connected with the handle 11. The receiving tube is formed with multiple locating holes 121. The extendable/retractable shank 13 is slidably fitted in the receiving tube 12. The extendable/retractable shank 13 is formed with a socket 131 in which the engagement unit 14 is mounted. The engagement unit 14 includes an engagement block 141 and an elastic member 142. When moving the extendable/retractable shank 13, the socket 131 of the extendable/retractable shank 13 is also moved. When the socket 131 is aligned with one of the locating holes 121 of the receiving tube 12, the engagement unit 14 is engaged in the locating hole 121 so as to fix the extendable/retractable shank 13. Accordingly, when it is desired to extend or retract the extendable/retractable shank 13, a user needs to press the engagement block 141 of the engagement unit 14 with a finger to move the engagement block 141 into the socket 131 so as to move the extendable/retractable shank 13 to another locating hole 121. After the engagement block 141 is aligned with the other locating hole 121, the engagement block 141 is restored to its home position to latch the other locating hole 121. Accordingly, the extendable/retractable shank 13 can be extended out of the receiving tube 12 or retracted into the receiving tube 12 to adjust the length of the hand tool. However, in order to smoothly move the extendable/retractable shank 13 along the receiving tube, the user must extent his/her finger into the locating hole 121 for pressing the engagement block 141 and fully moving the engagement block 141 into the socket 131. During the movement of the extendable/retractable shank 13, the user's finger is likely to be squeezed by the engagement block 141 and the wall face of the locating hole 121. As a result, the user's finger is apt to be pinched and injured. It is therefore tried by the applicant to provide a hand tool to overcome the above problem existing in the conventional hand tool.

SUMMARY OF THE INVENTION

It is therefore a primary object of the present invention to provide a hand tool including a handle and a shank body fitted in the handle. Only by means of pressing a press member with a finger, a user can unlatch the shank body from the handle, permitting the shank body to be extended or retracted to elongate or shorten the hand tool. Therefore, the user's finger is protected from being pinched and injured.

It is a further object of the present invention to provide the above hand tool. Only by means of pressing the press member with a finger, a user can unlatch the shank body from the handle, permitting the shank body to be rotated relative to the handle. Therefore, the user's finger is protected from being pinched and injured.

To achieve the above and other objects, the hand tool of the present invention includes a handle, a press member, a shank body and multiple latch assemblies. The handle is formed with a receiving cavity lengthwise extending along the handle. One end of the receiving cavity is an open end. A circumference of the handle is formed with a locating hole in communication with the receiving cavity. The press member is disposed in the locating hole and movable along the locating hole. A circumference of the shank body is formed with multiple sockets arranged in a lengthwise direction of the shank body. One end of the shank body is fitted through the open end of the handle into the receiving cavity and movable along the receiving cavity relative to the handle. The multiple latch assemblies are respectively disposed in the sockets and movable within the sockets. Each latch assembly has an elastic energy for keeping the latch assembly sliding outward from the socket.

When one of the sockets of the shank body is aligned with the locating hole, the latch assembly disposed in the socket is positioned in a latched position where a top end of the latch assembly is moved into the locating hole to latch the locating hole so as to latch the shank body with the handle. When pressing the press member, the press member pushes the aligned latch assembly to move out of the locating hole into the socket to an unlatched position where the latch assembly is separated from the locating hole to unlatch the shank body from the handle.

Accordingly, the shank body of the hand tool of the present invention is extendable/retractable to elongate or shorten the hand tool. A user only needs to press the press member with a finger for moving the latch assembly out of the locating hole and unlatching the shank body from the handle. Under such circumstance, the shank body can be slid relative to the handle by a certain distance and then located. Accordingly, the shank body can be extendable/retractable to elongate or shorten the force arm of the hand tool. Also, the shank body can be smoothly slid without extending the finger into the locating hole. Therefore, the user's finger is protected from being pinched and injured.

Still to achieve the above and other objects, the hand tool of the present includes a handle, a press member, a shank body and multiple latch assemblies. One end of the handle is inward recessed to form a receiving cavity. One end of the receiving cavity is an open end. A circumference of the handle is formed with a locating hole in communication with the receiving cavity. The press member is disposed in the locating hole and movable along the locating hole. Multiple sockets are formed on and annularly arranged on a circumference of the shank body. One end of the shank body is fitted through the open end of the handle into the receiving cavity and rotatable relative to the handle. The multiple latch assemblies are respectively disposed in the sockets and movable within the sockets. Each latch assembly has an elastic energy for keeping the latch assembly sliding outward from the socket.

When one of the sockets of the shank body is aligned with the locating hole, the latch assembly disposed in the socket is positioned in a latched position where a top end of the latch assembly is moved into the locating hole to latch the locating hole so as to latch the shank body with the handle. When pressing the press member, the press member pushes the aligned latch assembly to move out of the locating hole into the socket to an unlatched position where the latch assembly is separated from the locating hole to unlatch the shank body from the handle.

Accordingly, a user only needs to press the press member with a finger to move the latch assembly out of the locating hole and unlatch the shank body from the handle. Accordingly, the shank body can be rotated to a different angular position and then located without extending the finger into the locating hole. Therefore, the user's finger is protected from being pinched and injured.

The present invention can be best understood through the following description and accompanying drawings, wherein:

DETAILED DESCRIPTION OF THE PREFERRED EMBODIMENTS

Figure 1:
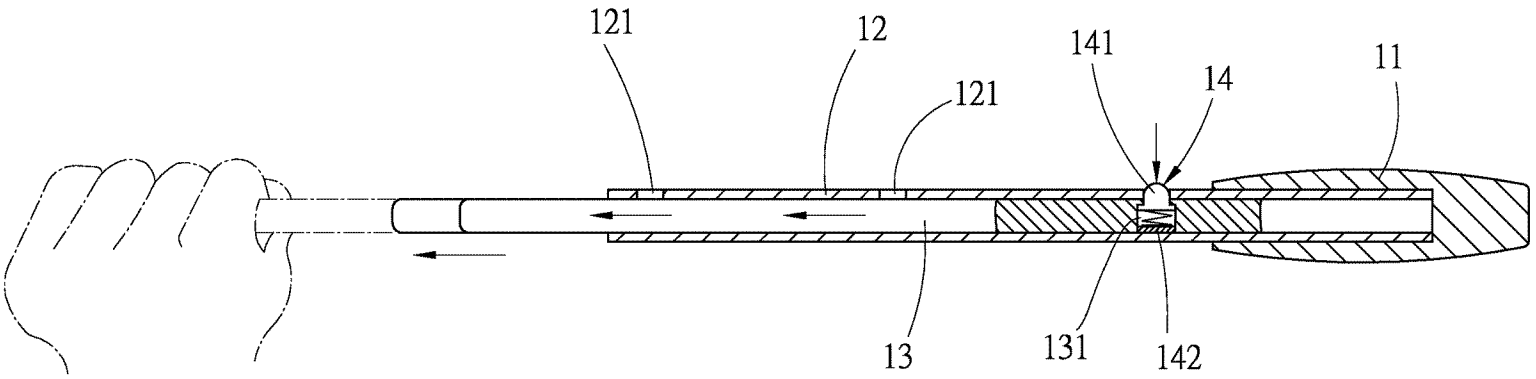
Fig. 1 PRIOR ART
FIG. 1 is a sectional view of a conventional extendable/retractable hand tool.

Please refer to FIGS. 2 to 9. According to a first embodiment, the hand tool 20 of the present invention includes a handle 30, a press member 40, a shank body 50 and two latch assemblies 60.

Figure 2:
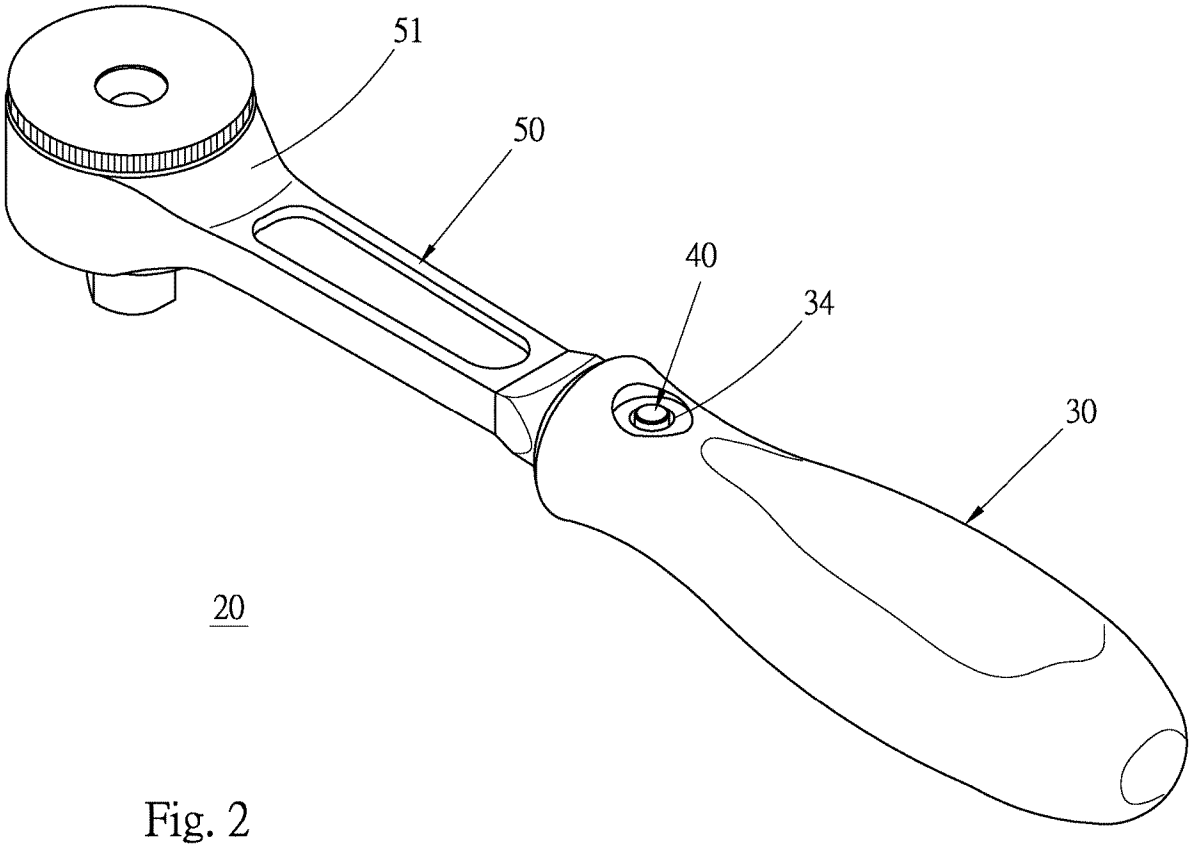
FIG. 2 is a perspective view of a first embodiment of the hand tool of the present invention, showing that the shank body is not extended.
Figure 5:
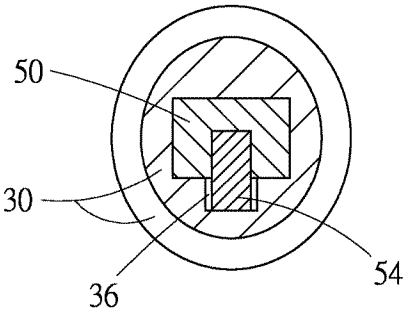
FIG. 5 is a sectional view taken along line 5-5 of FIG. 4.
Figure 4:
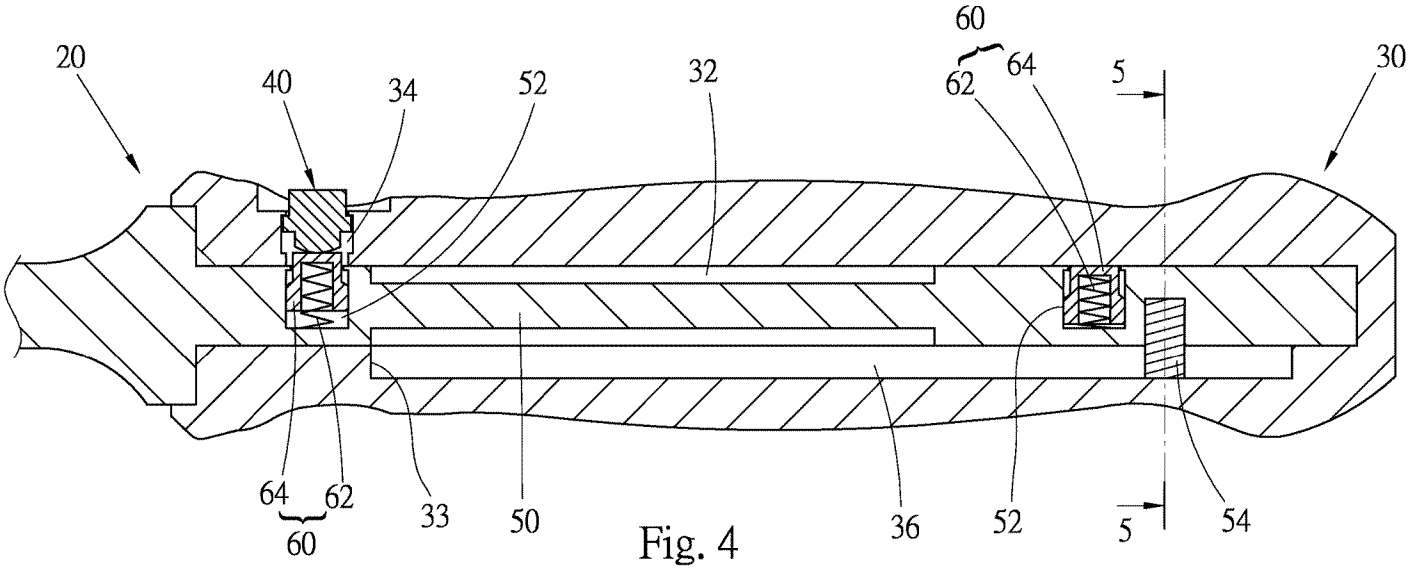
FIG. 4 is a longitudinal sectional view of the first embodiment of the hand tool of the present invention, showing that the shank body is latched with the handle.
Figure 7:
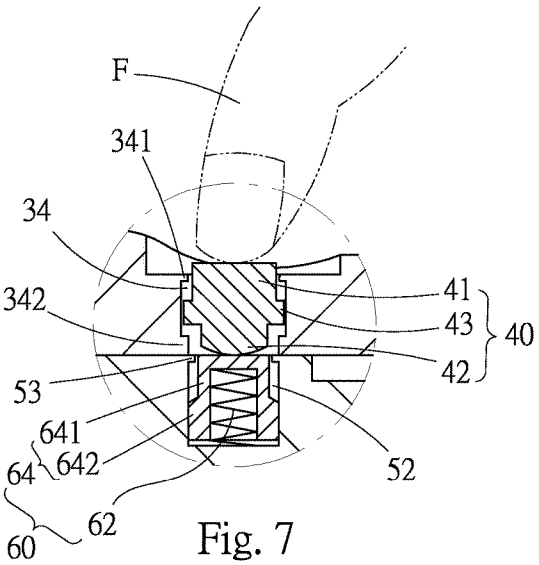
FIG. 7 is an enlarged view of circled area of FIG. 6, showing that the press member is pressed by a finger.

Please refer to FIGS. 2 and 4. The handle 30 is an elongated handle body having an arched surface for a user to easily hold. The handle 30 is formed with an internal receiving cavity 32 lengthwise extending along the handle 30. One end of the receiving cavity 32 passes through one end of the handle to form an open end for the shank body 50 to fit in. The circumference of the handle 30 is formed with a locating hole 34 in communication with the receiving cavity 32. A top end and a bottom end of the wall face of the locating hole 34 are respectively formed with a top flange 341 and a bottom flange 342, which are annular flanges (as shown in FIG. 7). A wall face of the receiving cavity 32 is formed with an elongated channel 36 lengthwise extending along the receiving cavity 32 (as shown in FIGS. 4 and 5).

Figure 6:
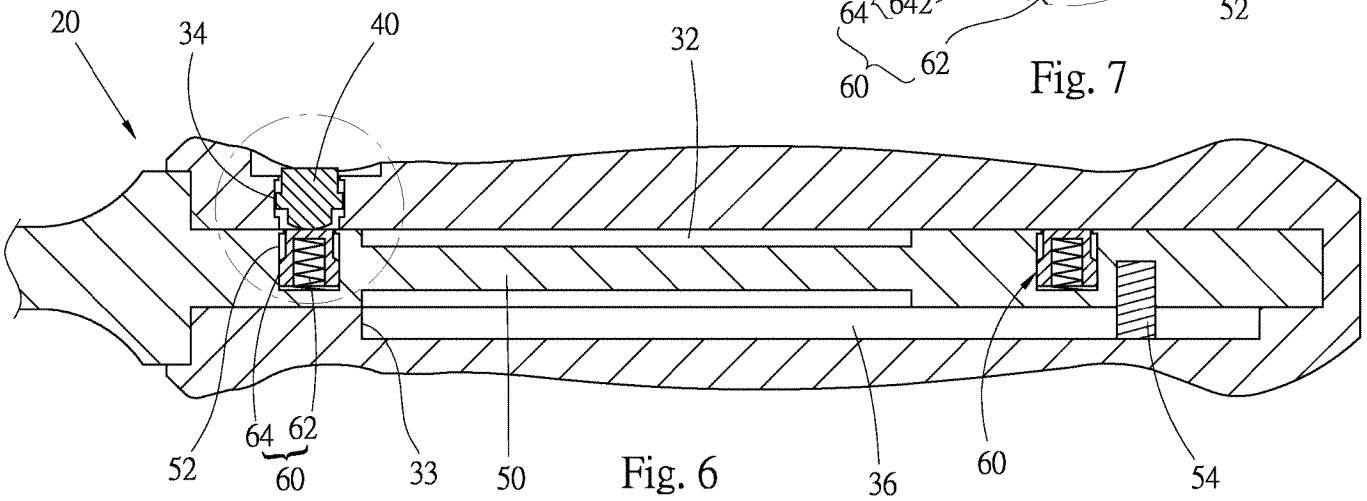
FIG. 6 is a longitudinal sectional view of the first embodiment of the hand tool of the present invention, showing that the press member is pressed to unlatch the shank body from the handle.

Please refer to FIGS. 4 and 6. The press member 40 can be a pushbutton. The press member 40 is movably disposed in the locating hole 34 for a user to press. Also referring to FIG. 7, the press member 40 is cylindrically shaped, having a top end 41, a bottom end 42 and a protrusion abutment section 43 positioned between the top end 41 and the bottom end 42. The protrusion abutment section 43 has an outer diameter larger than the outer diameter of the top end 41 and the outer diameter of the bottom end 42. The protrusion abutment section 43 abuts against the wall face of the locating hole and is restricted between the top flange 341 and the bottom flange 342, whereby the press member 40 is prevented from detaching out of the locating hole 34. A user can press the top end 41 of the press member 40 to make the bottom end 42 of the press member 40 contact the latch assemblies 60.

Figure 3:
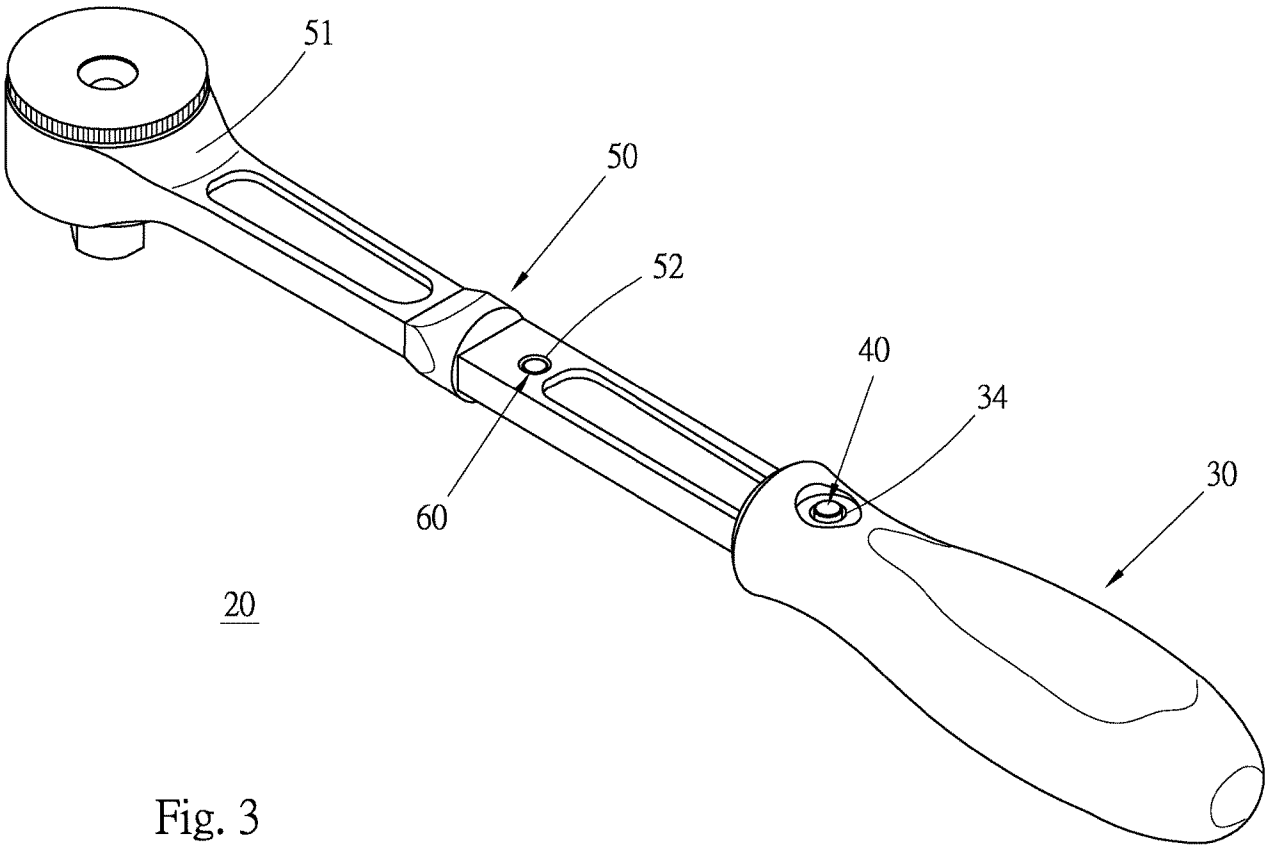
FIG. 3 is a perspective view of the first embodiment of the hand tool of the present invention, showing that the shank body is extended.
Figure 8:
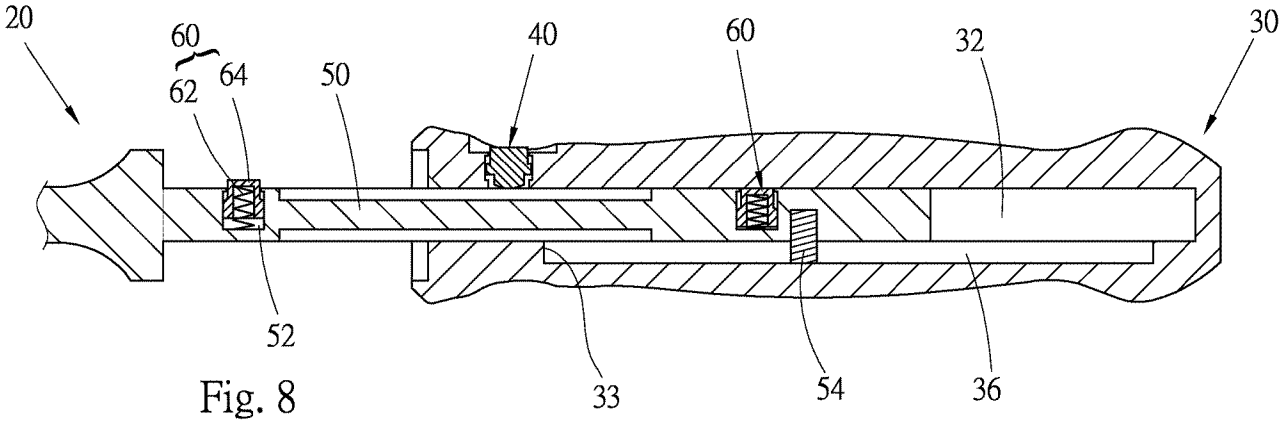
FIG. 8 is a longitudinal sectional view of the first embodiment of the hand tool of the present invention, showing that the shank body is moved relative to the handle.

Please refer to FIGS. 2 and 3. The shank body 50 is an elongated shank body. A tool bit 51 is disposed at one end of the shank body 50. The handle 30 is correspondingly assembled with the other end of the shank body 50. The tool bit 51 can have any form and is not limited to that of this embodiment. The shank body 50 is fitted through the open end of the handle 30 into the receiving cavity 32 and is lengthwise slidable along the receiving cavity 32. As shown in FIGS. 4, 6 and 8, a circumference of the shank body 50 is formed with two or more sockets 52 arranged in the lengthwise direction of the shank body 50. The sockets 52 are arranged at equal intervals or unequal intervals. During the movement of the shank body 50 relative to the handle 30, one of the sockets 52 can be aligned with the locating hole 34 of the handle 30. The wall face of top end of each socket 52 is formed with an abutment flange 53 (as shown in FIG. 7). In addition, a restriction member 54 is disposed at a rear end of the shank body 50. The restriction member 54 is received in the elongated channel 36 of the receiving cavity 32 of the handle 30 (as shown in FIGS. 4 and 5). The restriction member 54 is restricted to only lengthwise slide along the elongated channel 36 without possibility of rotation. During the movement of the shank body 50, the restriction member 54 is moved along the elongated channel 36 to finally abut against a front wall 33 of the receiving cavity 32. Accordingly, the shank body 50 is restricted within the receiving cavity 32 of the handle 30 without possibility of detaching out of the handle (as shown in FIG. 9).

Please refer to FIGS. 4, 6 and 8. Two or more latch assemblies 60 are respectively correspondingly mounted in the two sockets 52 of the shank body. The latch assemblies 60 are slidable within the sockets 52 to protract out of the sockets 52 or retract into the sockets 52 so as to latch/unlatch the locating holes 34. In this embodiment, each latch assembly 60 has an elastic energy for keeping the latch assembly 60 sliding outward from the socket 52. The number of the latch assemblies 60 is adjustable according to the number of the sockets 52. As shown in FIG. 7, in this embodiment, each latch assembly 60 includes an elastic member 62 and an engagement column 64. The elastic member 62 is fixedly disposed in the socket 52 to provide an elastic energy. The engagement column 64 is disposed in the socket 52 and movable along the socket 52. The engagement column 64 has a hollow interior for receiving the elastic member. Two ends of the elastic member 62 respectively abut against the socket 52 and the engagement column 64 to elastically push the engagement column 64. When the socket 52 is right aligned with the locating hole 34, the engagement column 64 is pushed by the elastic member, whereby a top end of the engagement column 64 extends into the locating hole. The engagement column 64 has a head section 641 and a main body 642. The head section 641 contacts and abuts against the bottom end 42 of the press member 40. The circumference of the main body 642 is formed with a shoulder section. The abutment flange 53 of the socket 52 serves to abut against the shoulder section of the main body 642, whereby the engagement column 64 can partially protract out of the socket 52 with the main body 642 hindered from detaching out of the socket 52. As shown in FIG. 9, when the latch assembly 60 is free from any external pressing force, the elastic member 62 elastically extends to make the head section 641 of the engagement column 64 protract out of the socket 52. The top end of the engagement column 64 can be made with an arched shape or domed shape.

Figure 9:
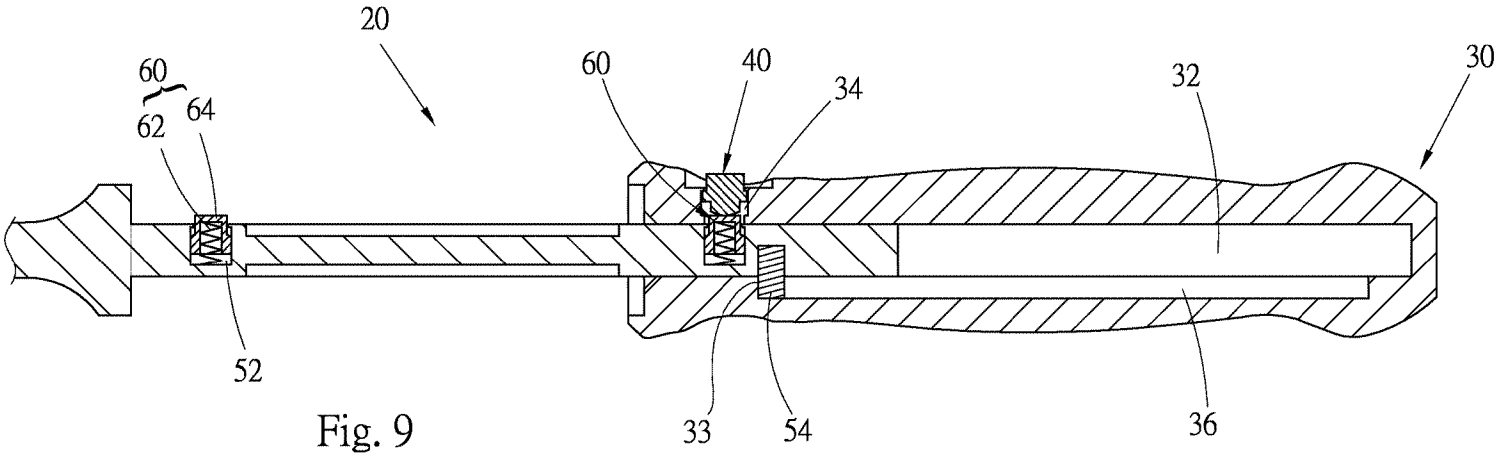
FIG. 9 is a longitudinal sectional view of the first embodiment of the hand tool of the present invention, showing that the shank body is extended and the other latch assembly latches the shank body with the handle.

Please further refer to FIGS. 4, 6 and 9. The operation of the first embodiment of the present invention is described hereinafter:

The press member 40 is movably mounted in the locating hole 34 of the handle 30. The shank body 50 is fitted in the receiving cavity 32. The two latch assemblies 60 disposed in the sockets 52 of the shank body 50 can be selectively aligned with the locating hole 34, wherein:

(1) When one socket 52 of the shank body 50 is aligned with the locating hole 34, the engagement column 64 of the latch assembly 60 disposed in the socket 52 is moved into the locating hole 34 to a latched position to latch the locating hole 34 (as shown in FIG. 4). At this time, the latch assembly 60 latches the shank body 50 with the handle 30 in a latched state, whereby the shank body 50 cannot be slid.

(2) When it is desired to extend the shank body 50 or retract the shank body 50, a user presses the press member 40 to make the press member 40 slide into the locating hole 34 to push the corresponding latch assembly 60 to an unlatched position where the engagement column 64 of the latch assembly is moved out of the locating hole 34 into the socket 52. At this time, the engagement column 64 is separated from the locating hole 34 (as shown in FIG. 6) to unlatch the shank body 50 from the handle 30. Under such circumstance, the shank body 50 can be moved to extend or retract (as shown in FIG. 8).

(3) After the shank body 50 is extended and when the other latch assembly 60 is aligned with the locating hole 34, the latch assembly 60 is moved to a latched position where the engagement column 64 extends into the locating hole 34 to latch the locating hole 34 (as shown in FIG. 9) as in (1).

Therefore, the shank body 50 of the hand tool 20 of the present invention is extendable/retractable to elongate or shorten the hand tool. A user only needs to press the press member with a finger F (as shown in FIG. 7) for indirectly pressing the engagement column 64 of the latch assembly 60 to move out of the locating hole 34. Accordingly, the shank body 50 can be smoothly slid without extending the finger F into the locating hole 34. Therefore, the user's finger is protected from being pinched and injured.

Please now refer to FIGS. 10 to 18. According to a second embodiment, the hand tool 20 of the present invention includes a handle 30, a press member 40, a shank body 50 and three latch assemblies 60. Some components of the second embodiment are identical to that of the first embodiment and thus will not be repeatedly described.

Figure 10:
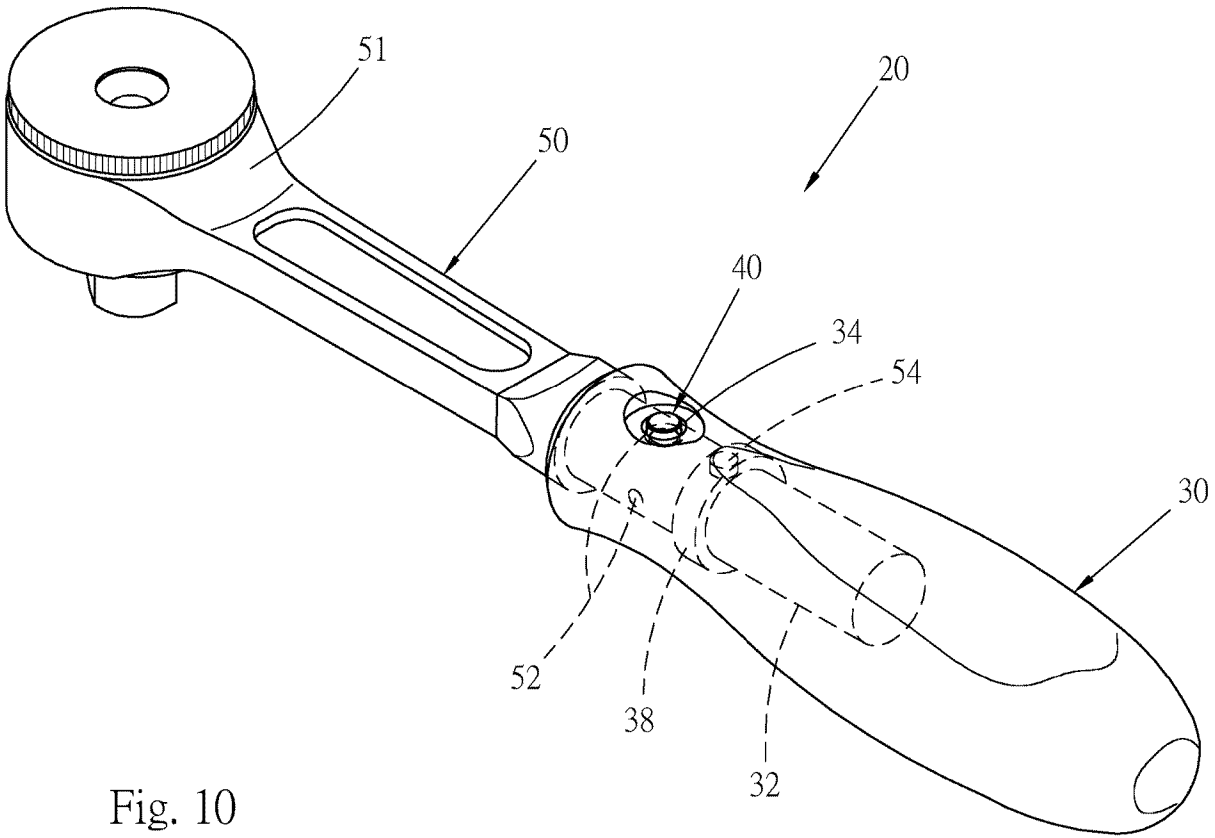
FIG. 10 is a perspective view of a second embodiment of the hand tool of the present invention.
Figure 11:
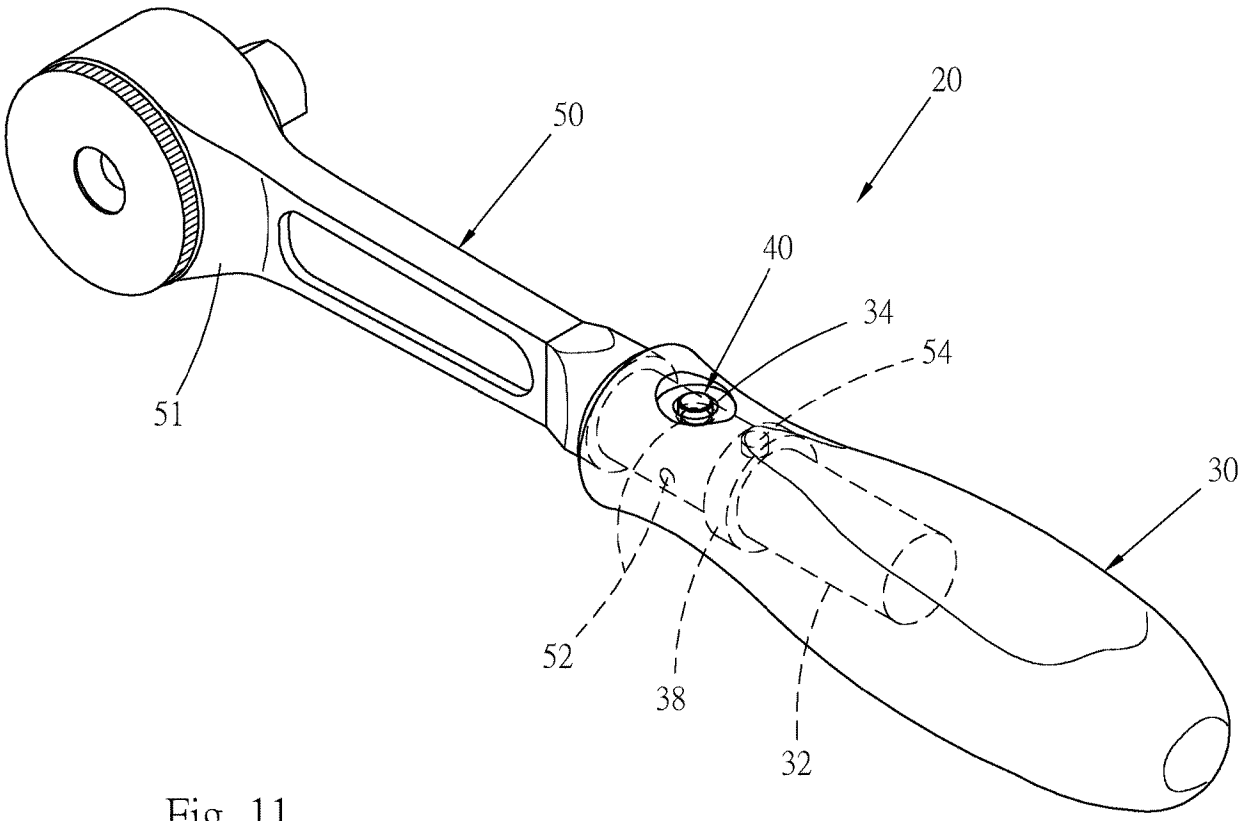
FIG. 11 is a perspective view of the second embodiment of the hand tool of the present invention, showing that the shank body is 90-degree rotated.
Figure 13:
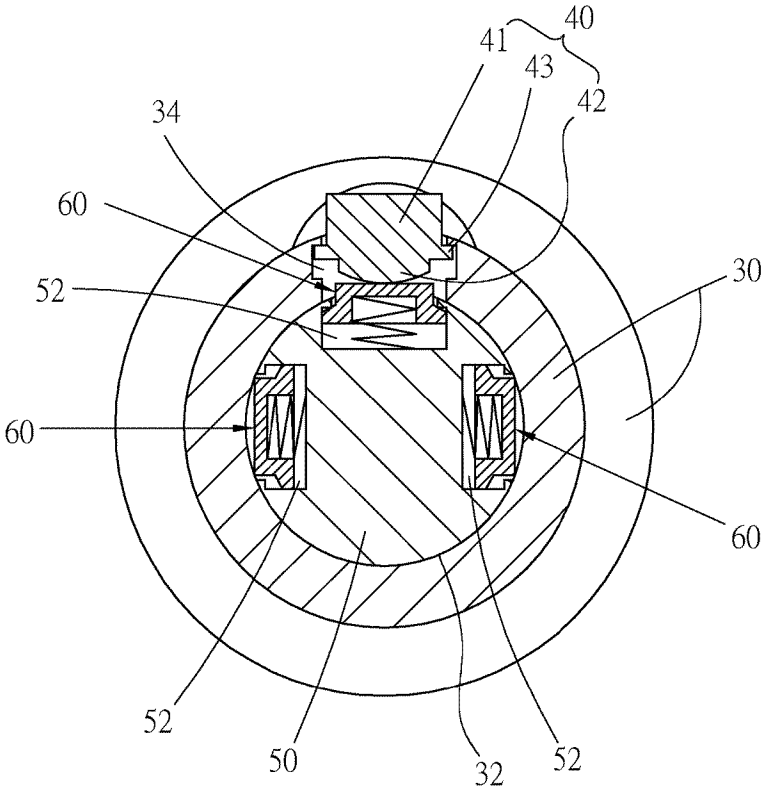
FIG. 13 is a sectional view taken along line 13-13 of FIG. 12.
Figure 16:
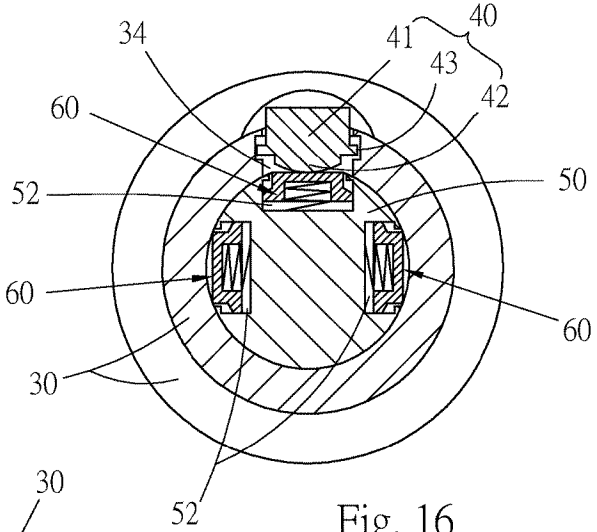
FIG. 16 is a sectional view taken along line 16-16 of FIG. 15, showing that the press member presses the latch assembly to unlatch the shank body from the handle.
Figure 18:
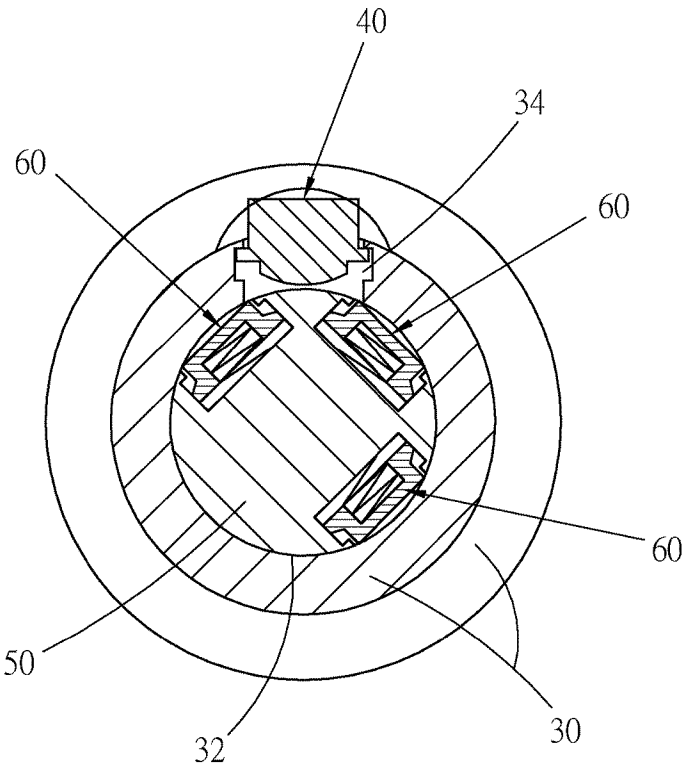
FIG. 18 is a sectional view according to FIG. 16, showing that after the shank body is unlatched, the shank body can be rotated relative to the handle.

Please refer to FIGS. 10, 11, 13, 16 and 18. The second embodiment is different from the first embodiment in that the shank body 50 is fitted in the receiving cavity 32 of the handle 30 and is rotatable relative to the handle 30. Accordingly, the tool bit 51 at one end of the shank body 50 can be rotated to different angular positions (as shown in FIGS. 10 and 11). Preferably, the shank body is a circular shank. Alternatively, at least a section of the shank body, which section is fitted in the receiving cavity, has a circular cross section. The receiving cavity has a cylindrical form as shown in FIG. 13. In this embodiment, three (or two or more than three) sockets (holes) 52 are annularly formed on the surface of the shank body 50. The sockets 52 are annularly arranged on the circumference of the shank body 50 in the same circle at equal intervals or unequal intervals. For example, four sockets are arranged on the circumference of the shank body at equal intervals. In this embodiment, the sockets 52 are arranged at 90-degree intervals. Accordingly, each time the shank body 50 is rotated relative to the handle 30 by 90 degrees, the sockets 52 are selectively rotationally aligned with the locating hole 32 of the handle 30 (as shown in FIGS. 16 and 18). In addition, three latch assemblies 60 are respectively mounted in the sockets 52 as in the first embodiment. The numbers and angular intervals of the sockets 52 and the latch assemblies 60 can be adjusted according to the requirement of practical use.

Figure 14:
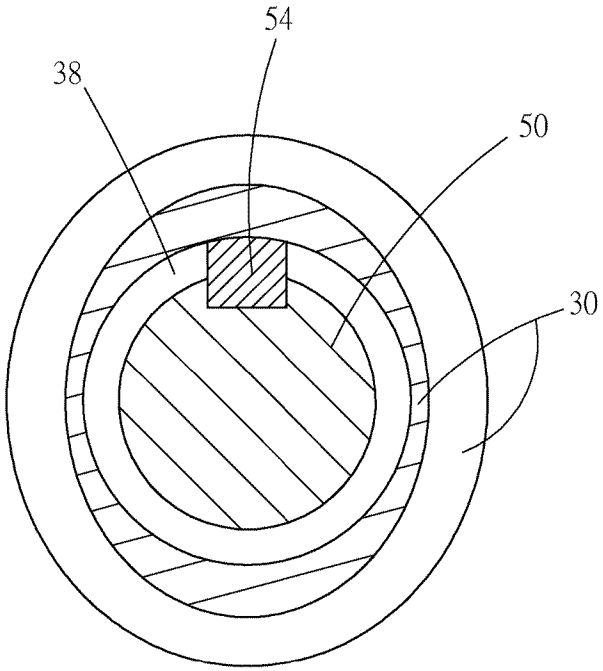
FIG. 14 is a sectional view taken along line 14-14 of FIG. 12.

Please refer to FIG. 14 and also refer to FIG. 10. The circumferential wall face of the receiving cavity 32 of the handle 30 is formed with an annular groove 38. A restriction member 54 is disposed on the circumference of the shank body 50. The restriction member 54 is correspondingly received in the annular groove 38. It can be seen from the drawings that the restriction member 54 of the shank body 50 is restricted to only rotate within the annular groove 38. Therefore, the shank body 50 can be only rotated within the receiving cavity 32 without possibility of sliding. In this case, the shank body 50 is prevented from detaching out of the receiving cavity 32.

Please further refer to FIGS. 12, 13 and 15 to 18. The press member 40 is mounted in the locating hole 34 of the handle 30. Three latch assemblies 60 are respectively mounted in the three sockets 52 of the shank body 50. The shank body 50 is fitted in the receiving cavity 32 of the handle 30 and rotatable relative to the handle 30.

Figure 12:
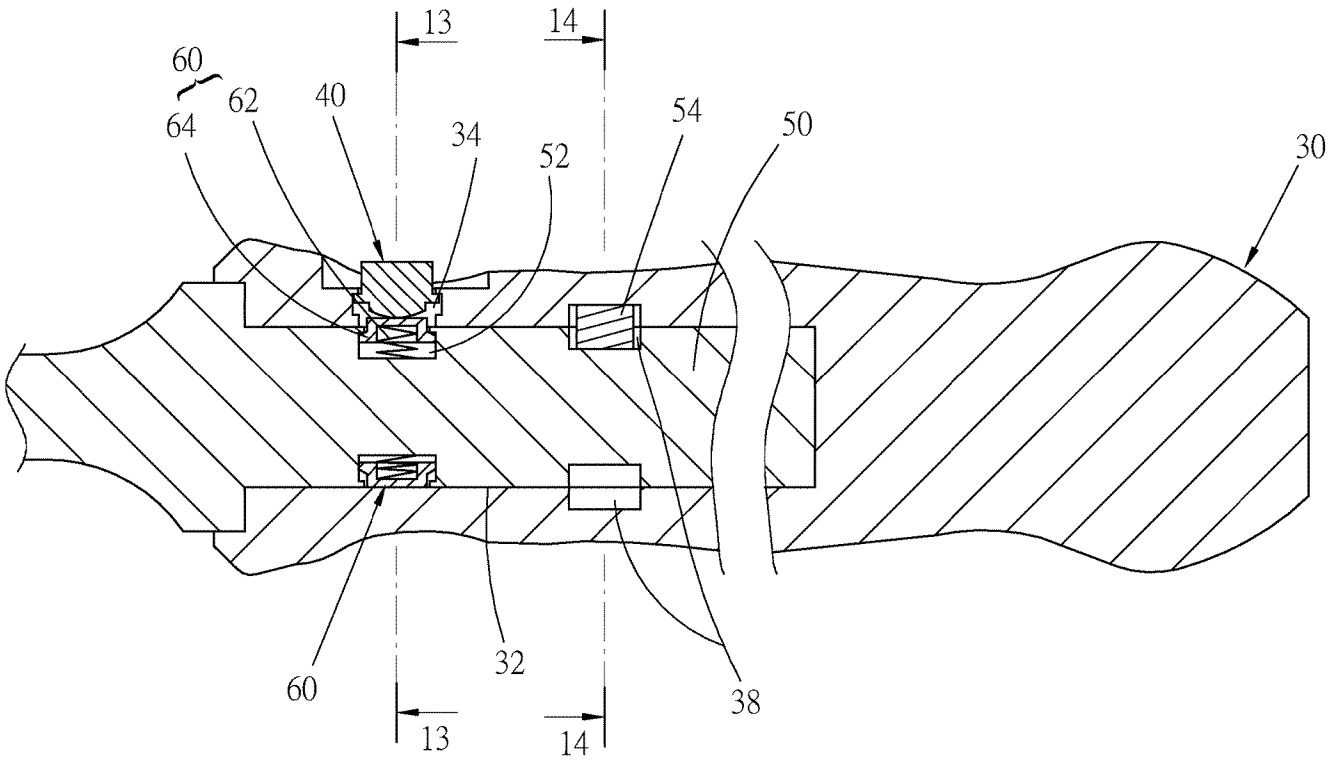
FIG. 12 is a longitudinal sectional view of the second embodiment of the hand tool of the present invention, showing that the shank body is latched with the handle.

The operation of the second embodiment of the present invention is described hereinafter:

(1) When one latch assembly 60 of the shank body 50 is aligned with the locating hole 34, the engagement column 64 of the latch assembly 60 is moved into the locating hole 34 to a latched position to latch the locating hole 34. At this time, the latch assembly 60 latches the shank body 50 with the handle 30 to prevent the shank body 50 from rotating relative to the handle 30 (as shown in FIGS. 12 and 13).

Figure 15:
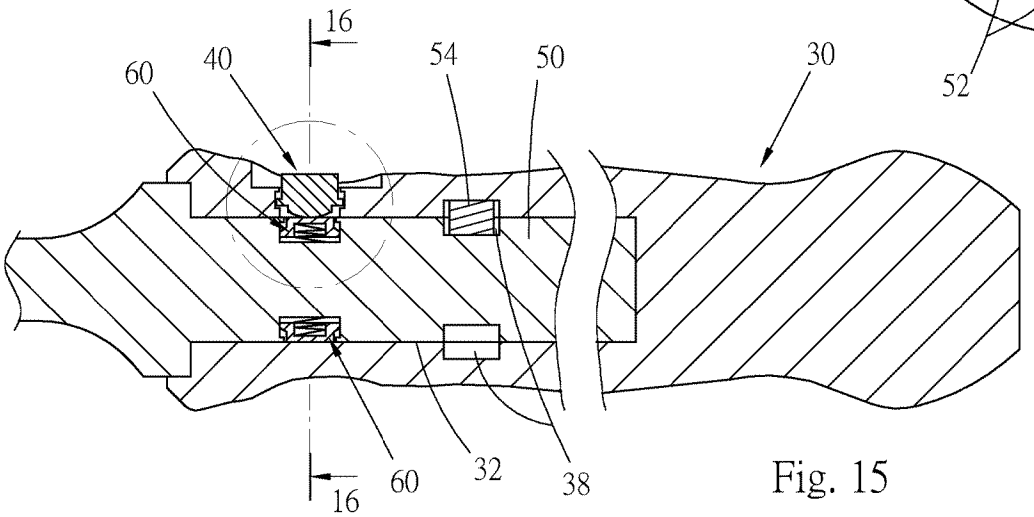
FIG. 15 is a longitudinal sectional view of the second embodiment of the hand tool of the present invention, showing that the press member is pressed to unlatch the shank body from the handle.

(2) When it is desired to rotate the shank body 50 or the handle 30 to a different angular position, a user presses the press member 40 to make the press member 40 push the engagement column 62 of the latch assembly 60 out of the locating hole 34 into the socket 52 to an unlatched position where the engagement column 64 is separated from the locating hole 34 (as shown in FIGS. 15 and 16) so as to unlatch the shank body 50 from the handle 30. Under such circumstance, the shank body 50 or the handle 30 can be rotated to a different angular position (as shown in FIG. 18).

(3) After the shank body 50 is rotated to the different angular position and when another latch assembly 60 is aligned with the locating hole 34, the latch assembly 60 is moved to a latched position where the engagement column 64 is moved into the locating hole 34 to latch the locating hole 34 so as to re-latch the shank body with the handle as in (1).

Figure 17:
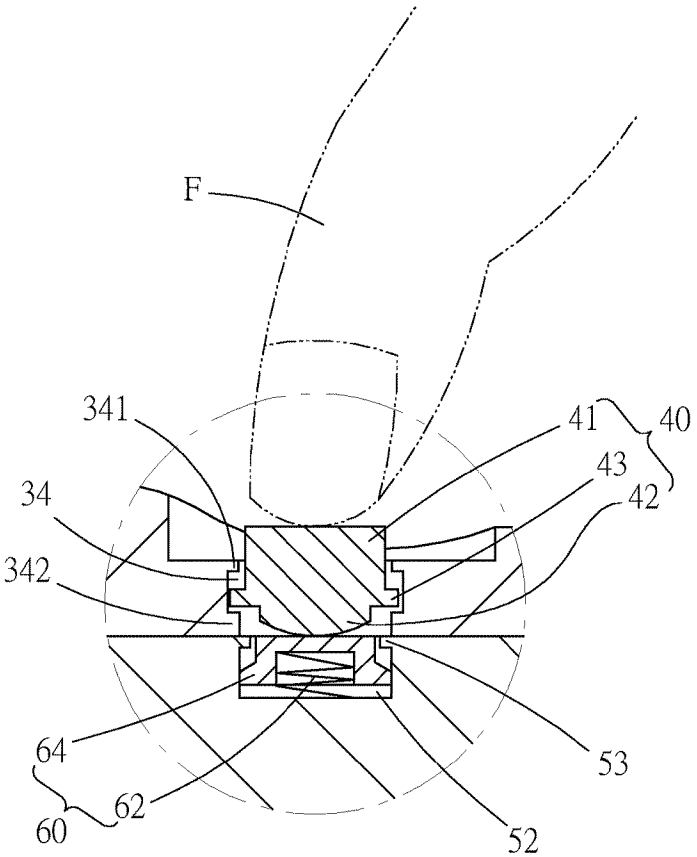
FIG. 17 is an enlarged view of circled area of FIG. 15, showing that the press member is pressed by a finger.

Therefore, the shank body 50 of the hand tool 20 of the present invention is rotatable relative to the handle. A user only needs to press the press member 40 with a finger F (as shown in FIG. 17) for pressing the engagement column 64 of the latch assembly 60 to move out of the locating hole 34. Accordingly, the shank body 50 can be rotated without extending the finger F into the locating hole 34. Therefore, the user's finger is protected from being pinched and injured.

In conclusion, the hand tool of the present invention includes one single press member and multiple cooperative latch assemblies disposed on the shank body. In operation, a user needn't extend his/her finger into the locating hole to touch the shank body. Therefore, the user's finger is protected from being pinched and injured. The present invention overcomes the problem existing in the conventional hand tool. In addition, the hand tool of the present invention is structurally characterized in that the shank body can be extended/retracted or rotated relative to the handle.

The above embodiments are only used to illustrate the present invention, not intended to limit the scope thereof. Many modifications of the above embodiments can be made without departing from the spirit of the present invention.

What is claimed is:

1. A hand tool, comprising:

a handle, one end of the handle being inward recessed to form a receiving cavity, one end of the receiving cavity being an open end, a circumference of the handle being formed with a locating hole in communication with the receiving cavity;

a press member disposed in the locating hole and movable along the locating hole;

a shank body, multiple holes being formed in and annularly arranged around a circumference of the shank body, one end of the shank body being fitted through the open end of the handle into the receiving cavity and rotatable relative to the handle; and multiple latch assemblies respectively disposed in the holes and movable within the holes, each latch assembly having an elastic energy for keeping the latch assembly sliding outward from the hole; when one of the holes of the shank body is aligned with the locating hole, the latch assembly disposed in the hole being positioned in a latched position where a top end of the latch assembly is moved into the locating hole to latch the locating hole and the shank body is latched with the handle preventing the shank body from rotating relative to the handle; when pressing the press member, the press member pushing the aligned latch assembly to move out of the locating hole into the hole to an unlatched position where the latch assembly is separated from the locating hole to unlatch the shank body from the handle allowing the shank body to rotate relative to the handle;

wherein a top end of the wall face of the locating hole of the handle is formed with a top flange; a protrusion abutment section with a larger outer diameter being formed on the circumference of the press member; whereby when the press member is moved outward from the locating hole, the protrusion abutment section abuts against the top flange.

2. The hand tool as claimed in claim 1, wherein a circumferential wall face of the receiving cavity of the handle is formed with an annular groove, a restriction member being disposed on the circumference of the shank body, the restriction member being received in the annular groove.

3. The hand tool as claimed in claim 1, wherein a bottom end of the wall face of the locating hole is further formed with a bottom flange; the protrusion abutment section being positioned between the top end and bottom end of the press member.

4. The hand tool as claimed in claim 1, wherein each latch assembly includes an elastic member and an engagement column, the engagement column being disposed in the hole and movable along the hole, the elastic member being disposed between the engagement column and the hole to always elastically push the engagement column outward from the hole; whereby when the hole is right aligned with the locating hole, a top end of the engagement column extends into the locating hole.

5. The hand tool as claimed in claim 4, wherein an abutment flange is formed on a wall face of each hole, the abutment flange serving to abut against the engagement column, whereby the engagement column can only partially protract out of the hole.

6. The hand tool as claimed in claim 2, wherein a bottom end of the wall face of the locating hole is further formed with a bottom flange; the protrusion abutment section being positioned between the top end and bottom end of the press member.

7. The hand tool as claimed in claim 2, wherein each latch assembly includes an elastic member and an engagement column, the engagement column being disposed in the hole and movable along the hole; the elastic member being disposed between the engagement column and the hole to always elastically push the engagement column outward from the hole, whereby when the hole is right aligned with the locating hole, a top end of the engagement column extends into the locating hole.

8. The hand tool as claimed in claim 1, wherein the receiving cavity has a cylindrical form and the section of the shank body, which section is fitted in the receiving cavity, has a circular cross section.

* * * * *